US010994391B2

(12) United States Patent
Flory

(10) Patent No.: US 10,994,391 B2
(45) Date of Patent: May 4, 2021

(54) MULTI-FUNCTIONAL SOCKET TOOL

(71) Applicant: Levi Flory, Spokane Valley, WA (US)

(72) Inventor: Levi Flory, Spokane Valley, WA (US)

( * ) Notice: Subject to any disclaimer, the term of this patent is extended or adjusted under 35 U.S.C. 154(b) by 282 days.

(21) Appl. No.: 16/202,855

(22) Filed: Nov. 28, 2018

(65) Prior Publication Data

US 2020/0164491 A1 May 28, 2020

(51) Int. Cl.
*B25B 13/06* (2006.01)
*B25B 23/00* (2006.01)

(52) U.S. Cl.
CPC ..... *B25B 13/065* (2013.01); *B25B 23/0035* (2013.01)

(58) Field of Classification Search
CPC .... B25B 13/06; B25B 13/065; B25B 23/0035
See application file for complete search history.

(56) References Cited

U.S. PATENT DOCUMENTS 5,048,379 A 9/1991 Gramera et al.
6,109,142 A 8/2000 Learng
6,354,176 B1 3/2002 Nordlin
7,281,310 B2 * 10/2007 Moore ..... B25B 13/06 29/456
7,340,984 B2 3/2008 Hsieh
10,675,739 B2 * 6/2020 Miley ..... B25B 13/102
2008/0041193 A1 * 2/2008 Baker ..... B25B 13/102 81/124.6
2013/0111750 A1 * 5/2013 Lesche ..... B25B 13/483 29/888.01
2013/0205561 A1 * 8/2013 Fanourgiakis ..... B25D 17/005 29/426.5

* cited by examiner

*Primary Examiner* — David B. Thomas
(74) *Attorney, Agent, or Firm* — Dale J. Ream

(57) ABSTRACT

A multi-functional socket tool for receiving connective assemblies includes a tool body defining a hollow interior area and opposed first and second ends and connective portions, respectively, defining first and second insertion apertures for receiving connecting assemblies into the interior area. The first connective portion includes a first segment operable to receive a connective assembly having a square configuration. The first connective portion includes a second segment displaced interiorly from the first segment having a threaded tubular member operable to receive a threaded connective assembly. The second connective portion includes a first segment having a hexagonal configuration operable to receive a connective assembly having a hexagonal configuration. The second connective portion includes a second segment interiorly displaced from the first segment of the second connective portion operable to receive a connective assembly having a square shaped configuration. Each connective portion may include a third segment having other configurations.

19 Claims, 24 Drawing Sheets

MULTI-FUNCTIONAL SOCKET TOOL

BACKGROUND OF THE INVENTION

This invention relates generally to socket tools, whether battery powered or manual, and, more particularly to a multi-functional socket tool having multiple segments spaced apart internally from opposed ends that are configured to mate with a plurality of connective assemblies in the nature of fasteners, fittings, and socket tools so that the connective assemblies may be mounted by operation of the socket tool.

Various fasteners, hardware, and hangers are installed to and removed from beam clamps or other fixtures of a structure using manual or battery powered socket tools or are manually installed. For instance, a beam clamp may need to be installed or coupled to a beam with a lock nut and then a threaded rod may need to be installed into the beam clamp, and various sized loop hangers may need installation to the beam or beam clamp. Typically, multiple tools are needed to make or to remove these installations, i.e. a plurality of tools may need to be present to install or remove all of these fasteners.

Various devices or proposals are found in the prior art for multi-function hand-tools. Although presumably effective for their intended purposes, the existing devices and proposals do not provide a multi-functional socket tool having multiple segments arranged longitudinally displaced from opposed ends of a tool body and arranged so that no one segment for receiving a respective type of fastener or hardware causes collision or conflict with any other segment. In other words, the present invention provides a multi-function socket tool capable of capturing a multiplicity of connective assemblies for being driven or coupled to a beam or beam clamp via a socket adapter or the like.

Therefore, it would be desirable to have a multi-function socket tool that overcomes the limitations of the prior multi-use tools or merely using separate and inefficient combinations of tools.

SUMMARY OF THE INVENTION

A multi-functional socket tool for receiving a plurality of connective assemblies according to the present invention includes a tool body having a cylindrical configuration defining a hollow interior area and including a first end opposite a second end, the first end having a first connective portion and the second end having a second connective portion. The first end has a first edge defining a first insertion aperture giving access to the interior area and operable to receive the connective assemblies. The second end has a second edge defining a second insertion aperture giving access to the interior area to receive the connective assemblies.

The first connective portion includes a first segment proximate the first end having four walls defining a square-shaped open space operable to receive a connective assembly having a square configuration. The first connective portion includes a second segment displaced interiorly from the first segment, the second segment of the first connective portion having a tubular member and a threaded surface operable to receive a threaded connective assembly. The second connective portion includes a first segment proximate the second end and having a hexagonal configuration operable to receive a connective assembly having a hexagonal configuration. The second connective portion includes a second segment interiorly displaced from the first segment of the second connective portion and having four walls that define a housing operable to receive a connective assembly having a square shaped configuration.

Therefore, a general object of this invention is to provide a multi-functional socket tool for receiving a plurality of connective assemblies, i.e. fasteners, hardware, and socket tools.

Another object of this invention is to provide a multi-functional socket tool, as aforesaid, that is able to receive a fastener or fitting in one end while receiving a driving tool such as a socket wrench or adapter in an opposite end.

Still another object of this invention is to provide a multi-functional socket tool, as aforesaid, that is capable of receiving a nut, a bolt head, a hanger, or the like for subsequent driving into a beam or other complementary structure.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
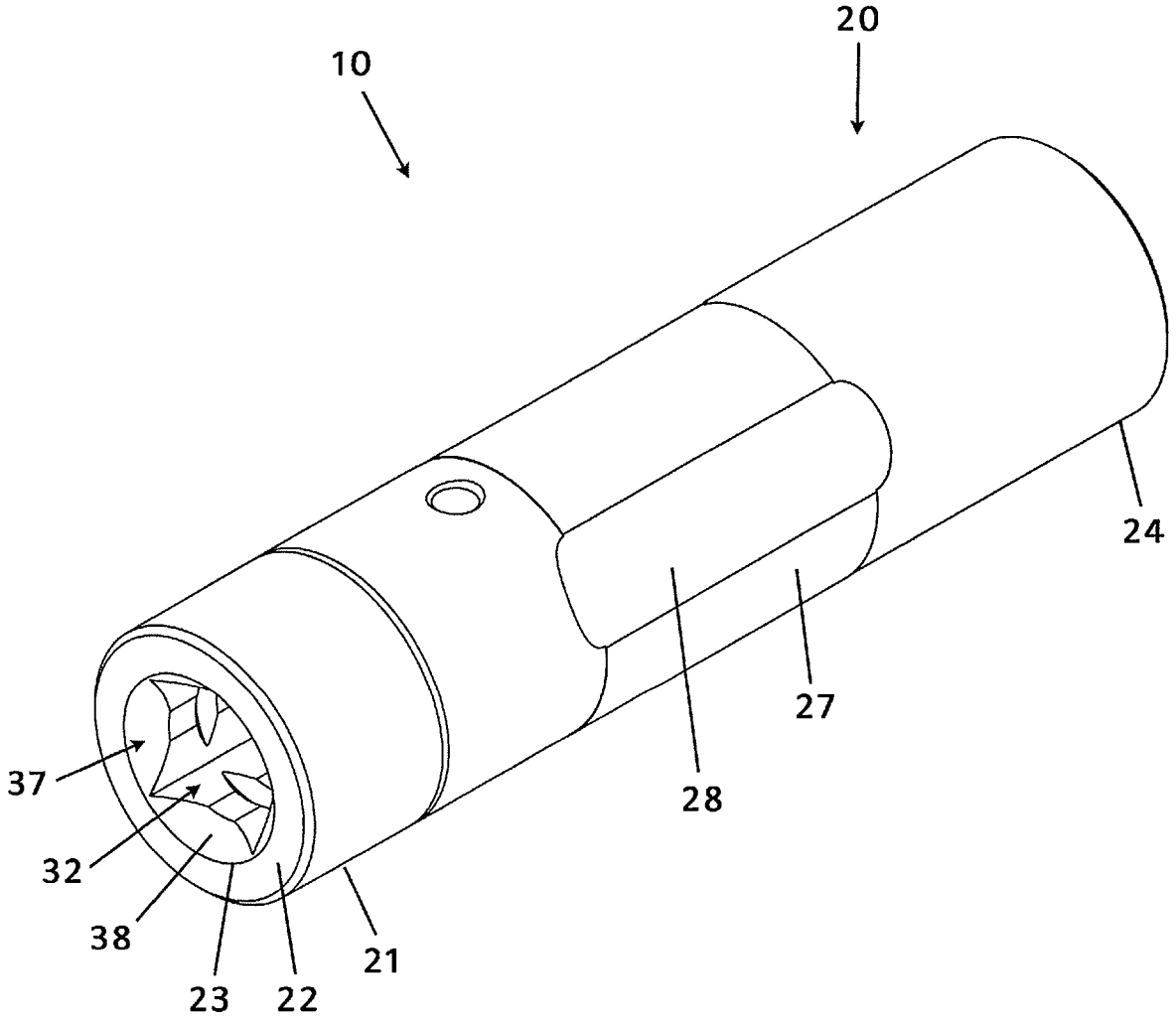
FIG. 1 is a perspective view of a multi-functional socket tool according to a preferred embodiment of the present invention, illustrated as viewed from a first end.
Figure 2:
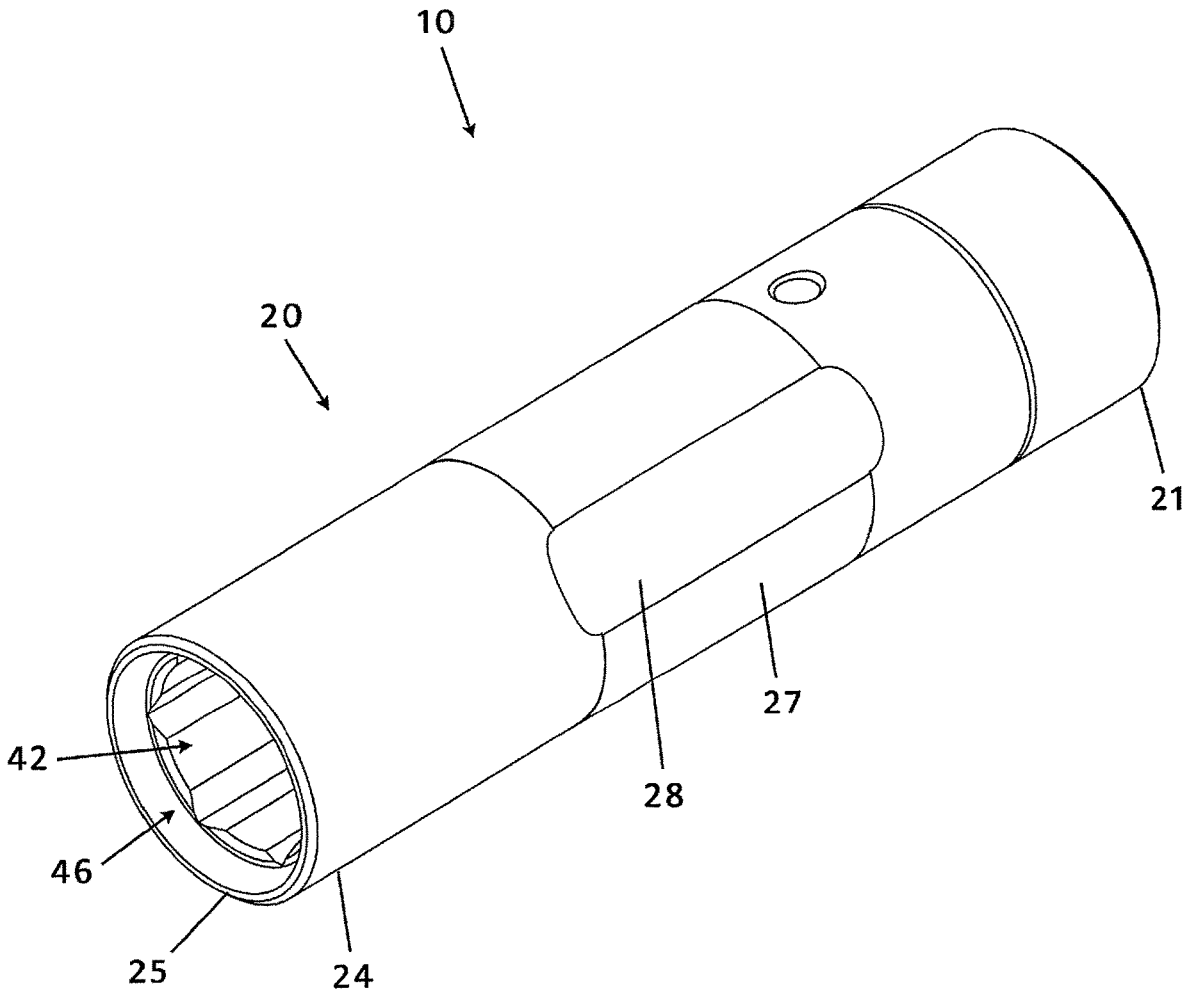
FIG. 2 is a perspective view of the socket tool as in FIG. 1, illustrated from a second end.

A multi-functional socket tool according to a preferred embodiment of the present invention will now be described with reference to FIGS. 1 to 37 of the accompanying drawings. The multi-functional socket tool 10 includes a tool body 20 having an opposed first end 21 and second end 24 and defining an interior area. The fasteners and tools that may be received into the tool body 20 may be referred to generically as connective assemblies, a plurality of connective assemblies, or just a singular connective assembly having a specific geometric or shape configuration. More particularly, it will be seen that the multi-functional socket tool 10 may receive an end of a socket adapter 12, nuts 14 or bolt heads 16, hanger fittings, or the like, and these components will be referred to a connective assemblies.

The tool body 20 includes a casing having a linear and cylindrical configuration, the tool body 20 having an exterior surface operable as a handle by which to apply fasteners to a work piece. The casing of the tool body 20 also has an interior surface and is hollow, i.e. defines an interior area. The tool body 20 may include a first end 21 opposite a second end 24. More particularly, each end includes a first edge 22 (i.e. a first end edge) and a second edge 25 (i.e. a second end edge) that define a first insertion aperture 23 and a second insertion aperture 26, respectively, each of which allow access into the hollow interior area defined by the tool body 20. The first end 21 and second end 24 are associated with a first connective portion 30 and second connective portion 40, respectively, and each connective portion includes a plurality of segments configured for receiving complementary connective assemblies or fasteners, as will be described in detail below.

Figure 8:
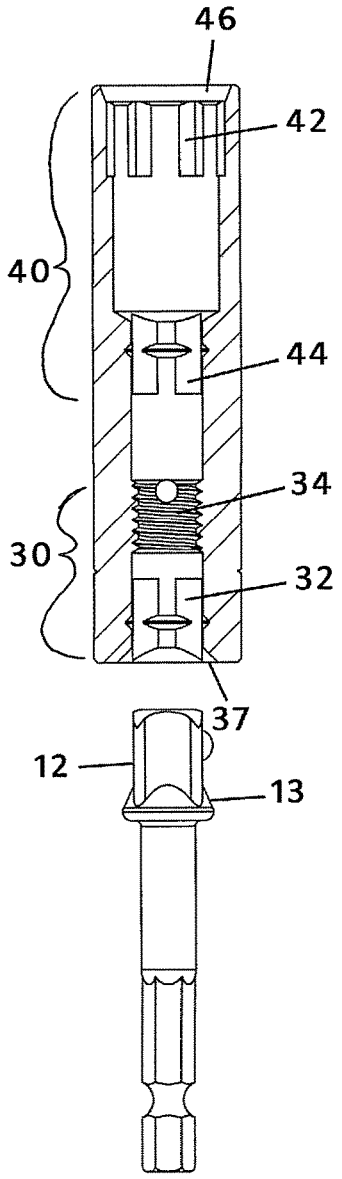
FIG. 8 is a sectional view as in FIG. 5B, illustrated in use with a socket adapter not yet inserted into the first end.
Figure 9:
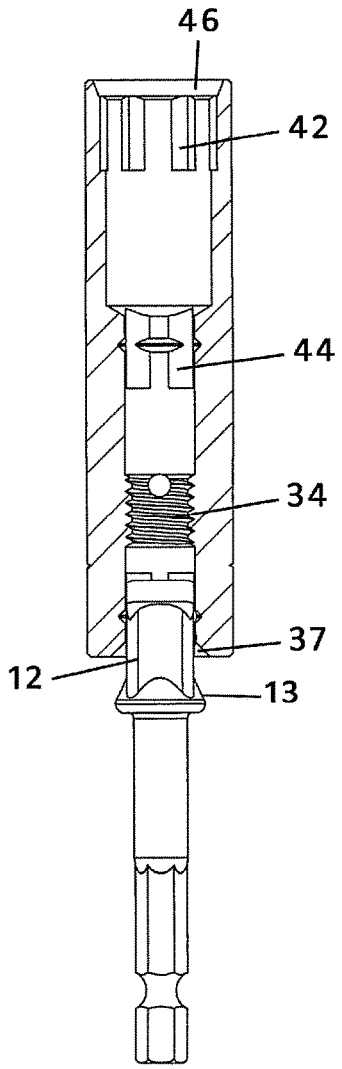
FIG. 9 is a sectional view as in FIG. 8, illustrated with the socket adapter almost fully inserted into the first end.
Figure 10:
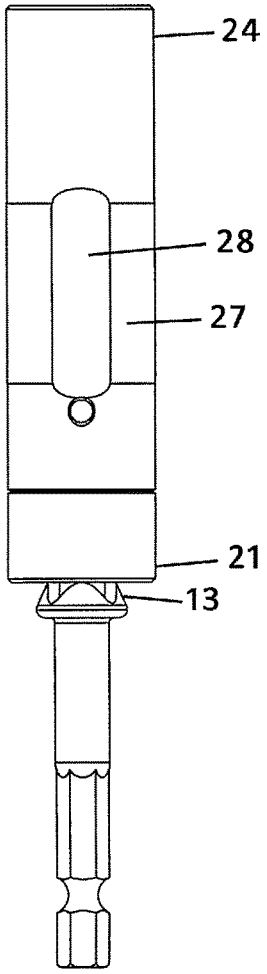
FIG. 10 is a top view of the socket tool as in FIG. 9.
Figure 11:
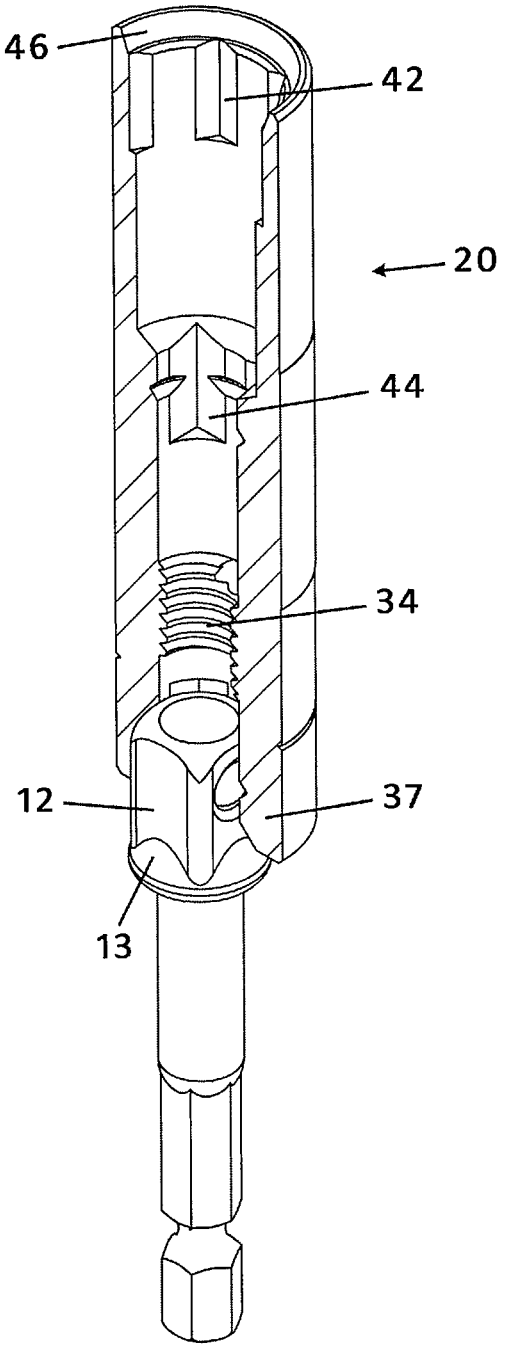
FIG. 11 is a fragmentary perspective view of the socket tool as in FIG. 10.
Figure 12:
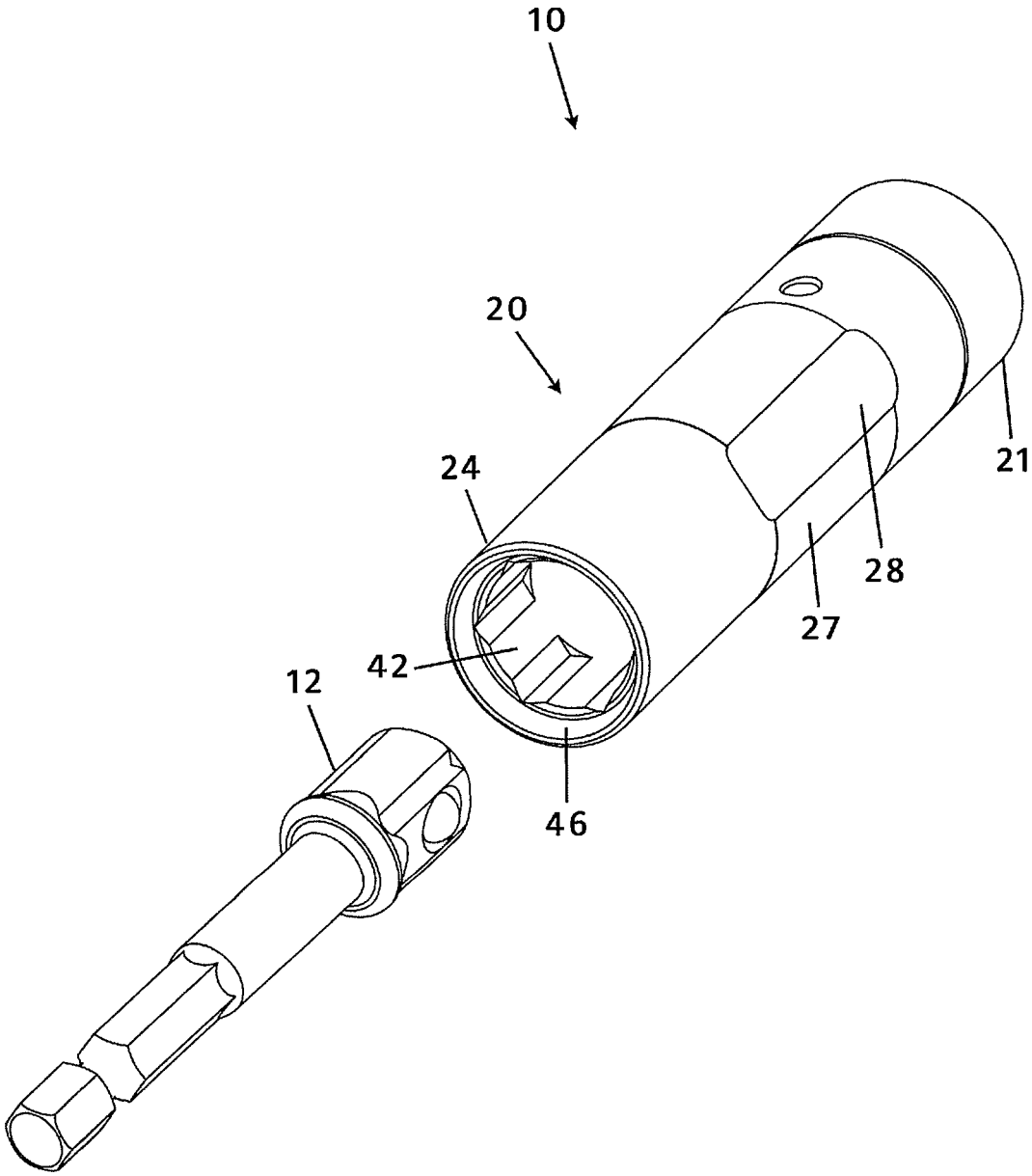
FIG. 12 is a perspective view of the socket tool as in FIG. 2, illustrated in use with a socket adapter not yet inserted into the socket tool.
Figure 13:
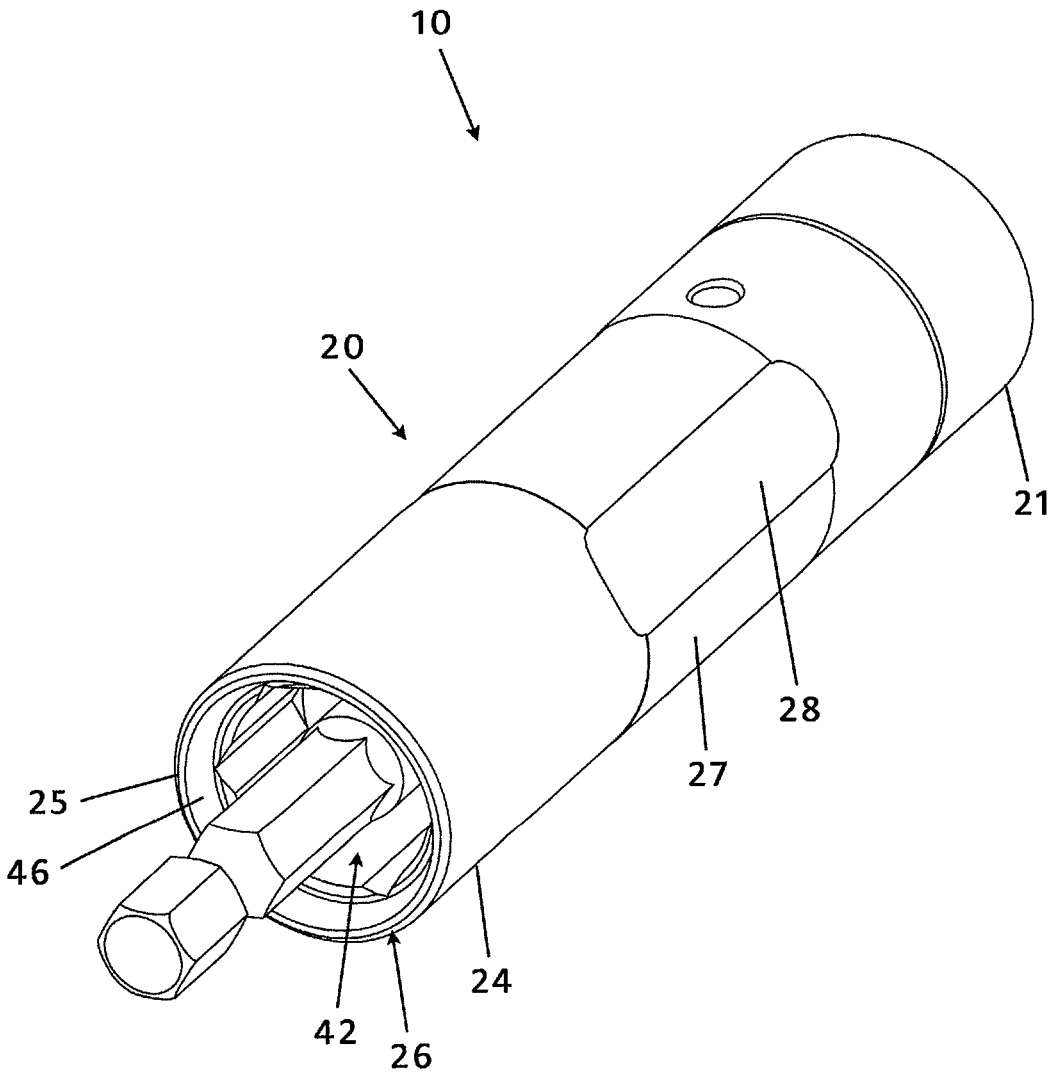
FIG. 13 is another perspective view of the socket tool as in FIG. 12, illustrated in use with a socket adapter fully inserted.
Figure 14:
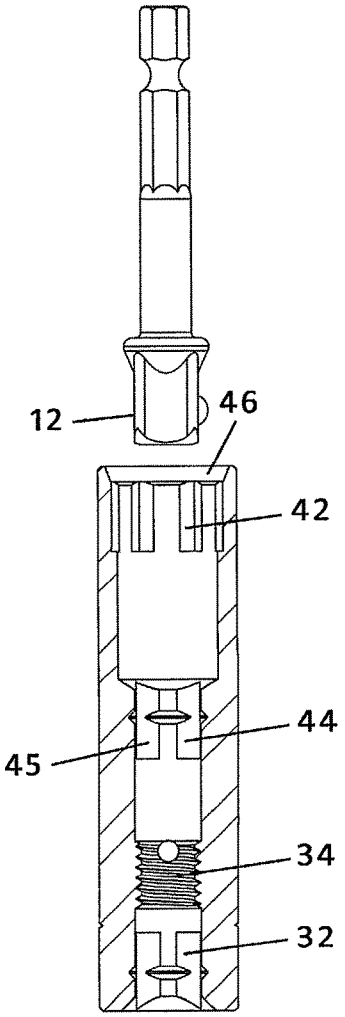
FIG. 14 is a sectional view as in FIG. 5B, illustrated in use with a socket adapter not yet inserted into the second end.
Figure 15:
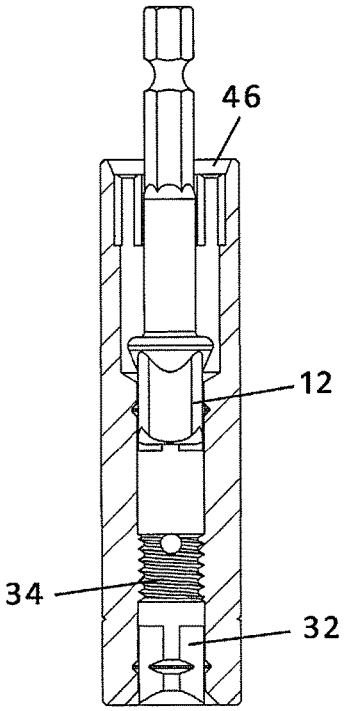
FIG. 15 is a sectional view as in FIG. 14, illustrated with the socket adapter almost fully inserted into the second end.
Figure 16:
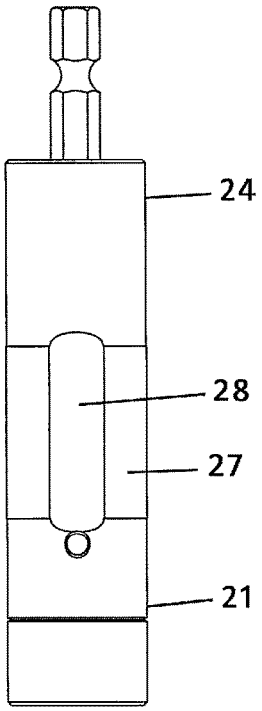
FIG. 16 is a top view of the socket tool as in FIG. 15.
Figure 17:
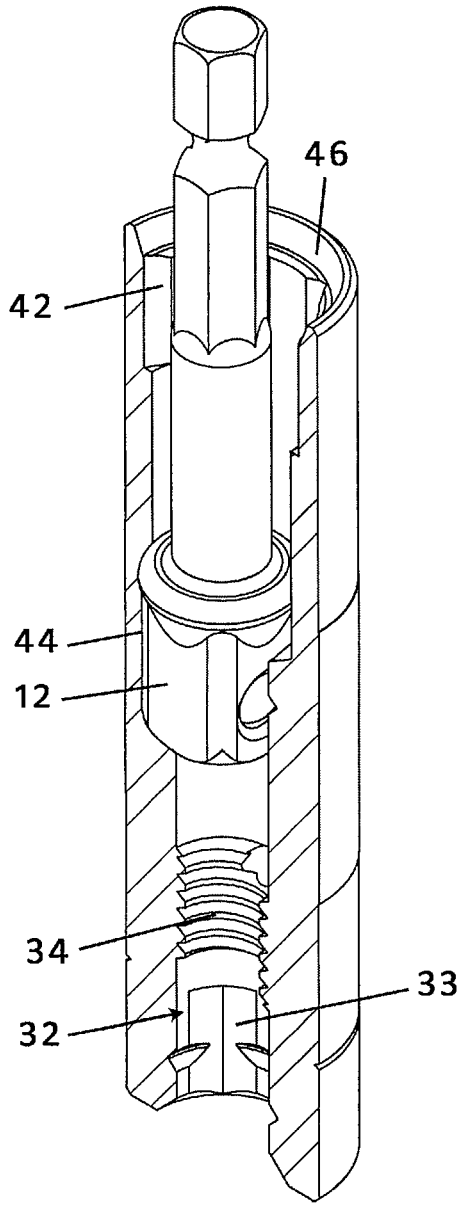
FIG. 17 is a fragmentary perspective view of the socket tool as in FIG. 16.
Figure 18:
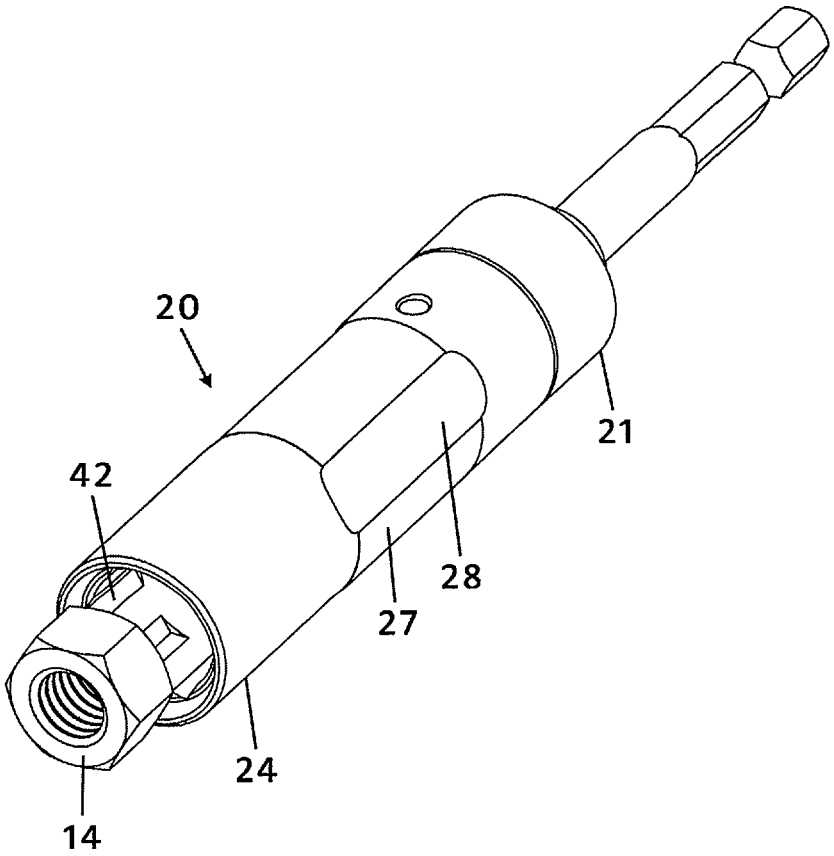
FIG. 18 is a perspective view of the socket tool as in FIG. 2, illustrated in use with a hex nut not yet inserted into the second end of the socket tool and a socket adapter proximate the first end thereof.
Figure 19:
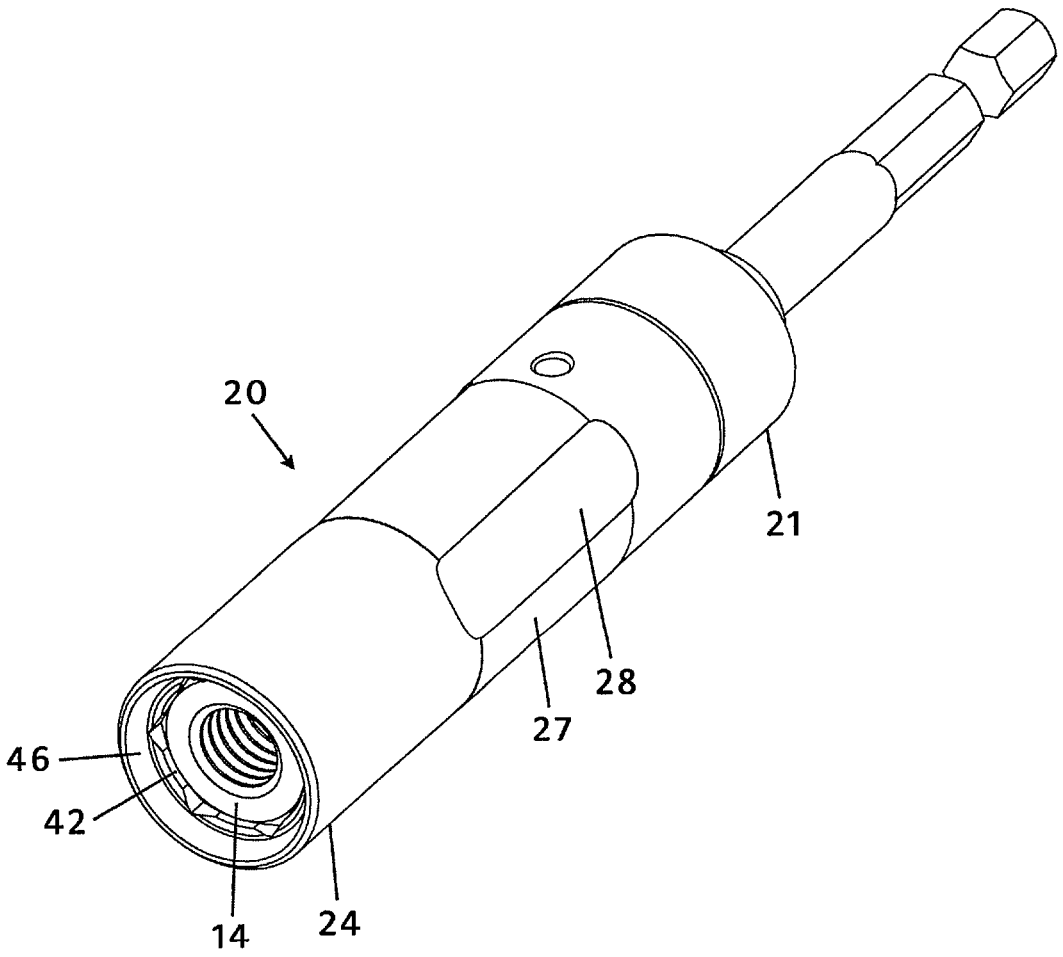
FIG. 19 is another perspective view of the socket tool as in FIG. 12, illustrated with a hex nut fully inserted into the second end of the socket tool and a socket adapter engaged with the first end thereof.
Figure 20:
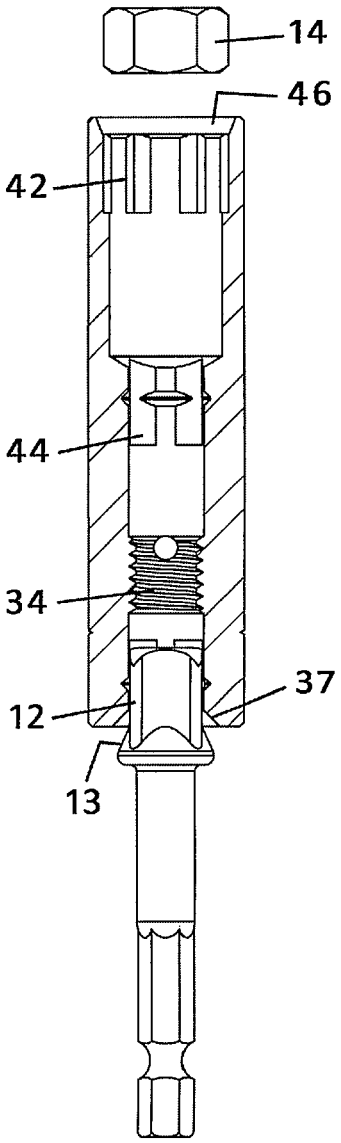
FIG. 20 is a sectional view as in FIG. 5B, illustrated in use with a hex nut not yet inserted into the second end.
Figure 21:
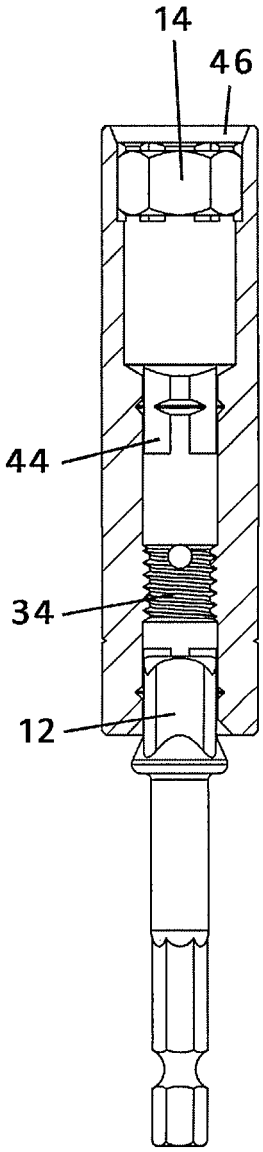
FIG. 21 is a sectional view as in FIG. 20, illustrated with the hex nut fully inserted into the second end.
Figure 22:
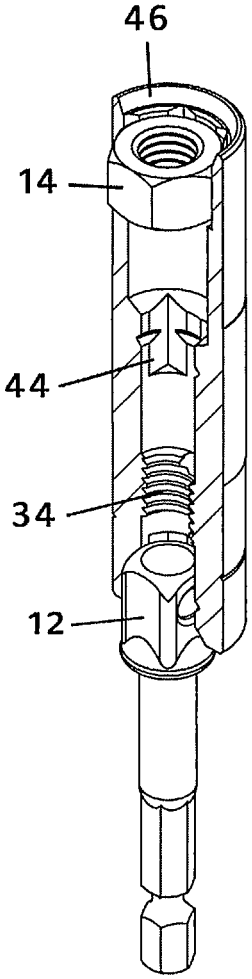
FIG. 22 is a fragmentary perspective view of the socket tool as in FIG. 21.
Figure 23:
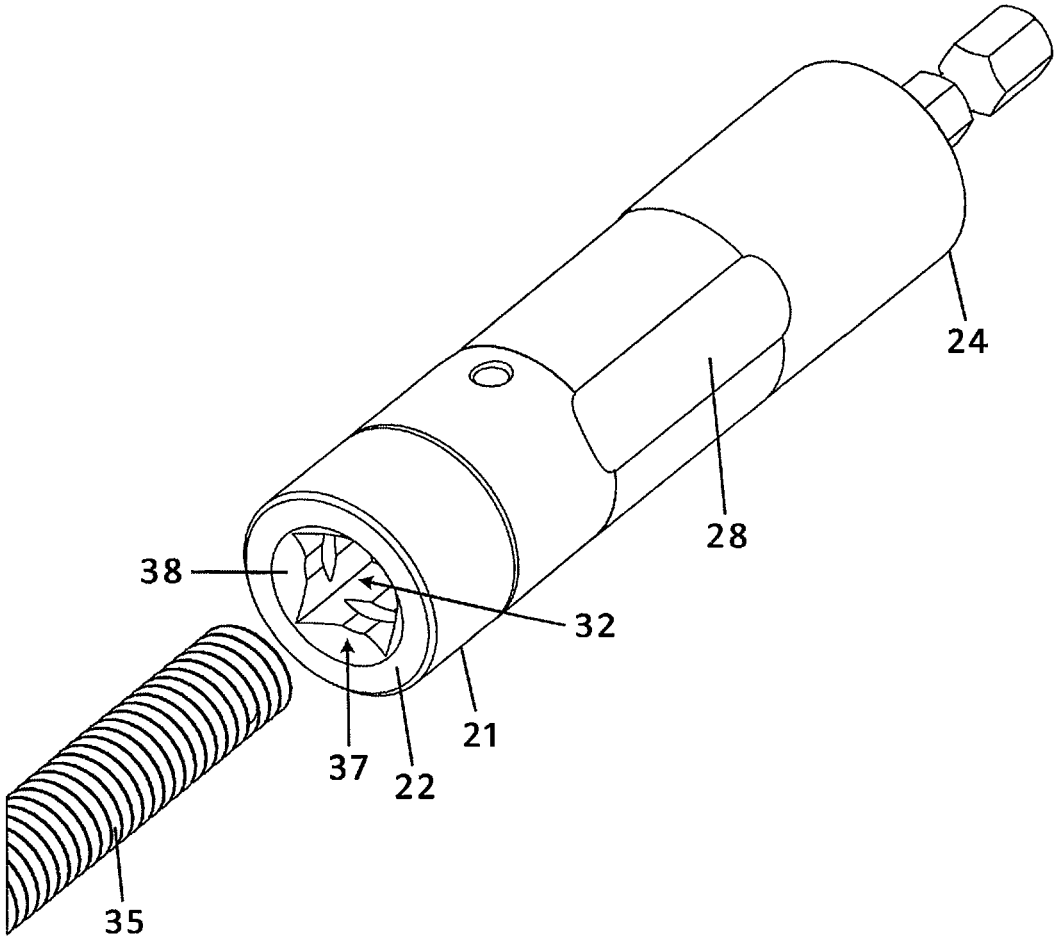
FIG. 23 is a perspective view of the socket tool as in FIG. 1, illustrated in use with a threaded rod not yet inserted into the first end of the tool body.
Figure 24:
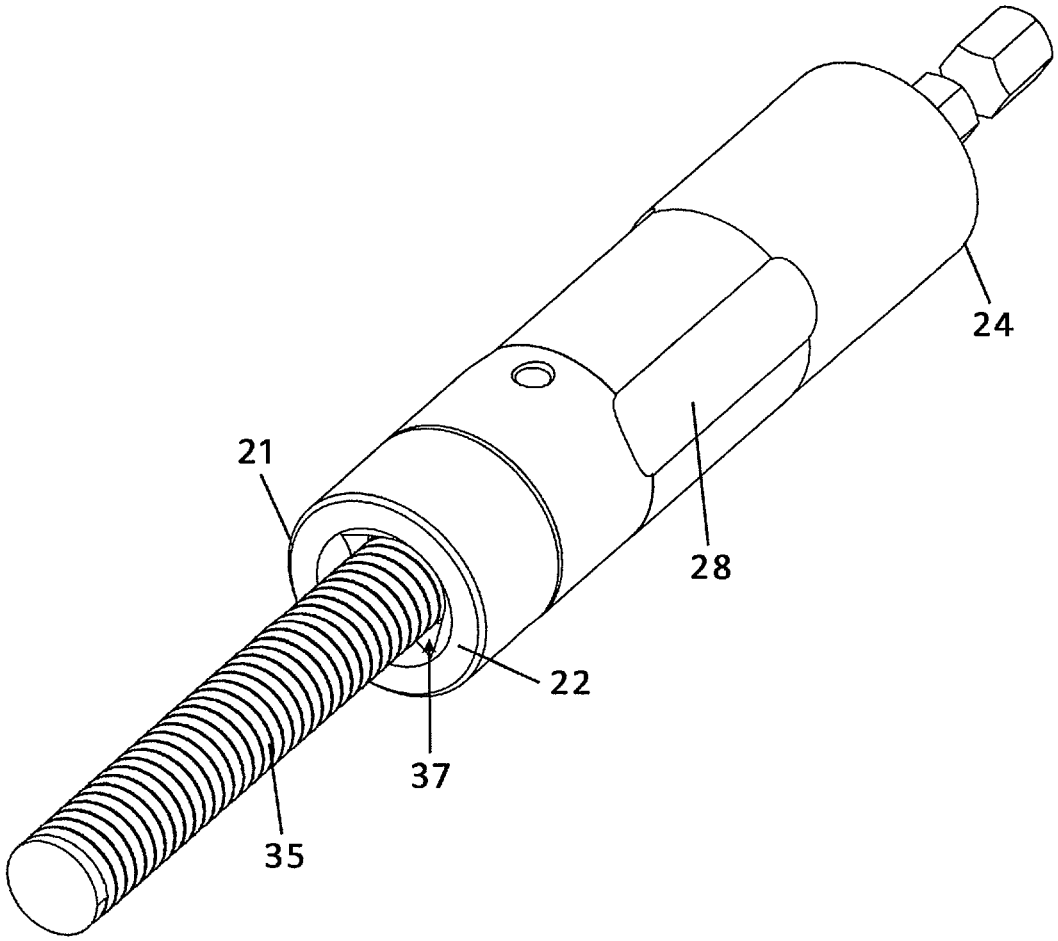
FIG. 24 is another perspective view of the socket tool as in FIG. 1, illustrated in use with a socket adapter fully inserted into the tool body.
Figure 25:
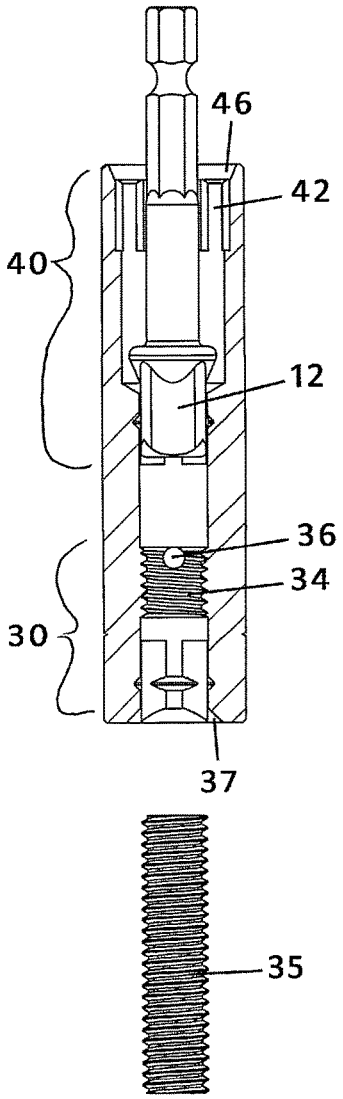
FIG. 25 is a sectional view as in FIG. 5B, illustrated in use with a threaded rod not yet inserted into the first end.
Figure 26:
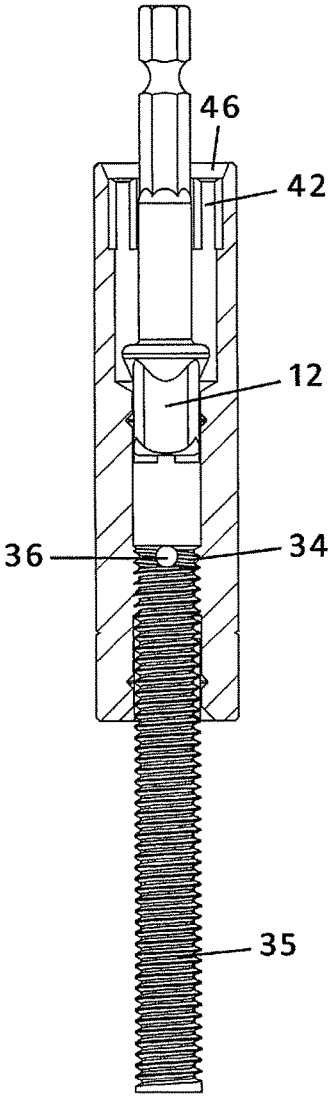
FIG. 26 is a sectional view as in FIG. 25, illustrated with the threaded rod fully inserted into the first end.
Figure 27:
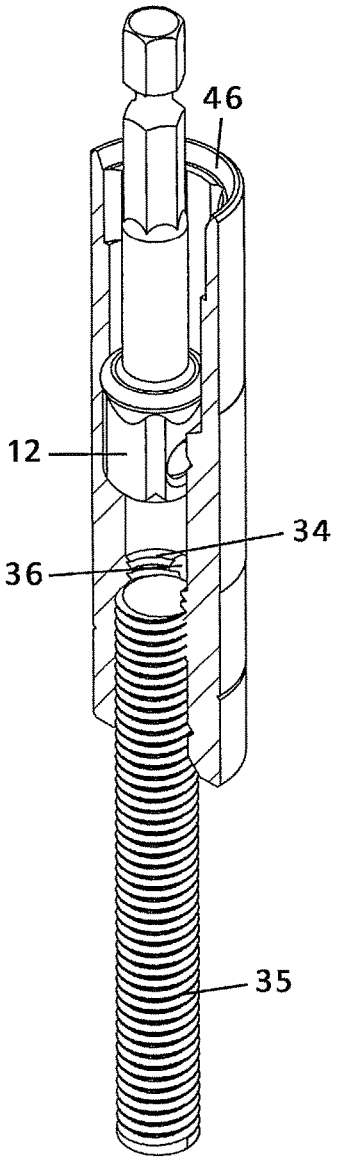
FIG. 27 is a fragmentary perspective view of the socket tool as in FIG. 26.
Figure 28:
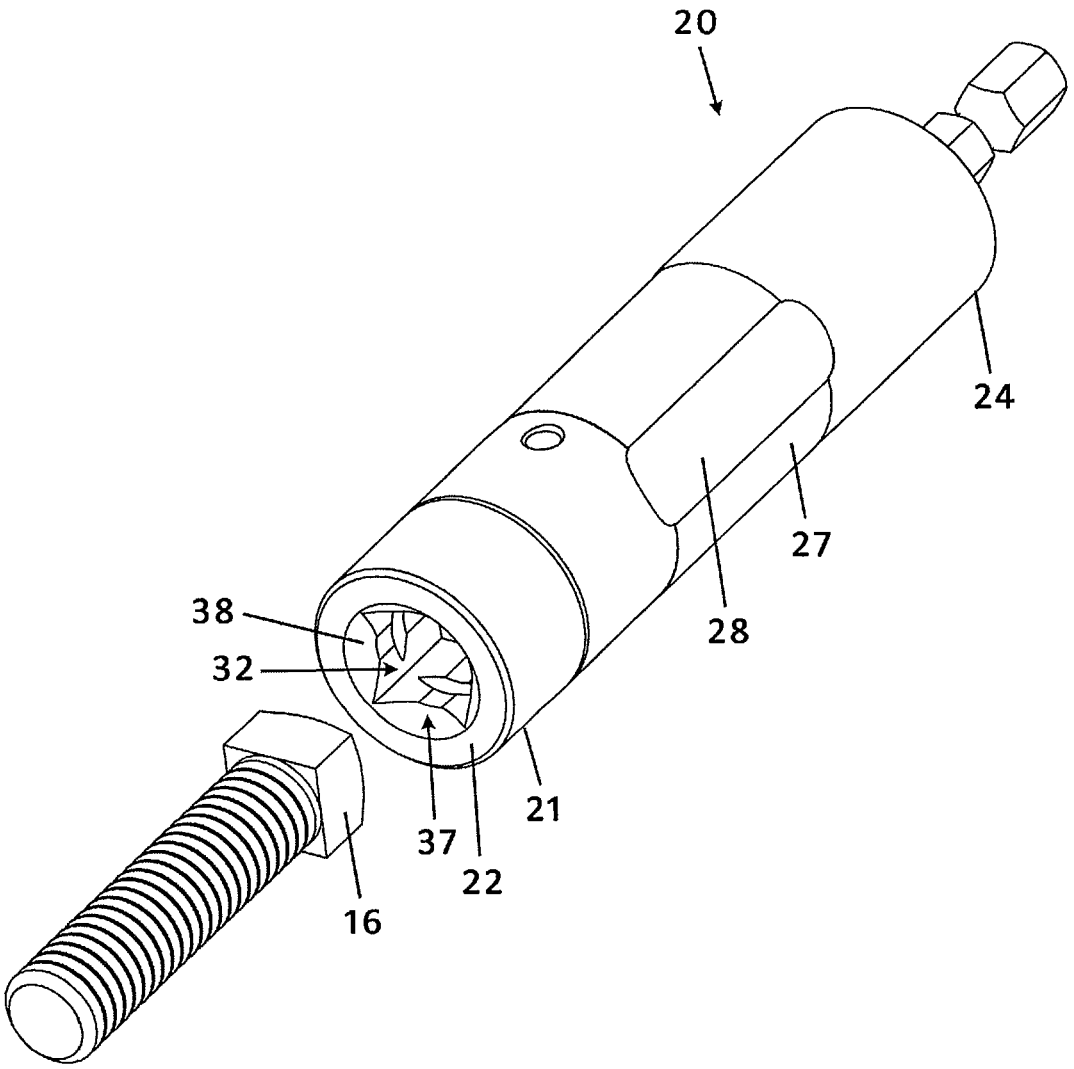
FIG. 28 is a perspective view of the socket tool as in FIG. 2, illustrated in use with a hex head bolt not yet inserted into the second end of the socket tool and a socket adapter proximate the first end thereof.
Figure 29:
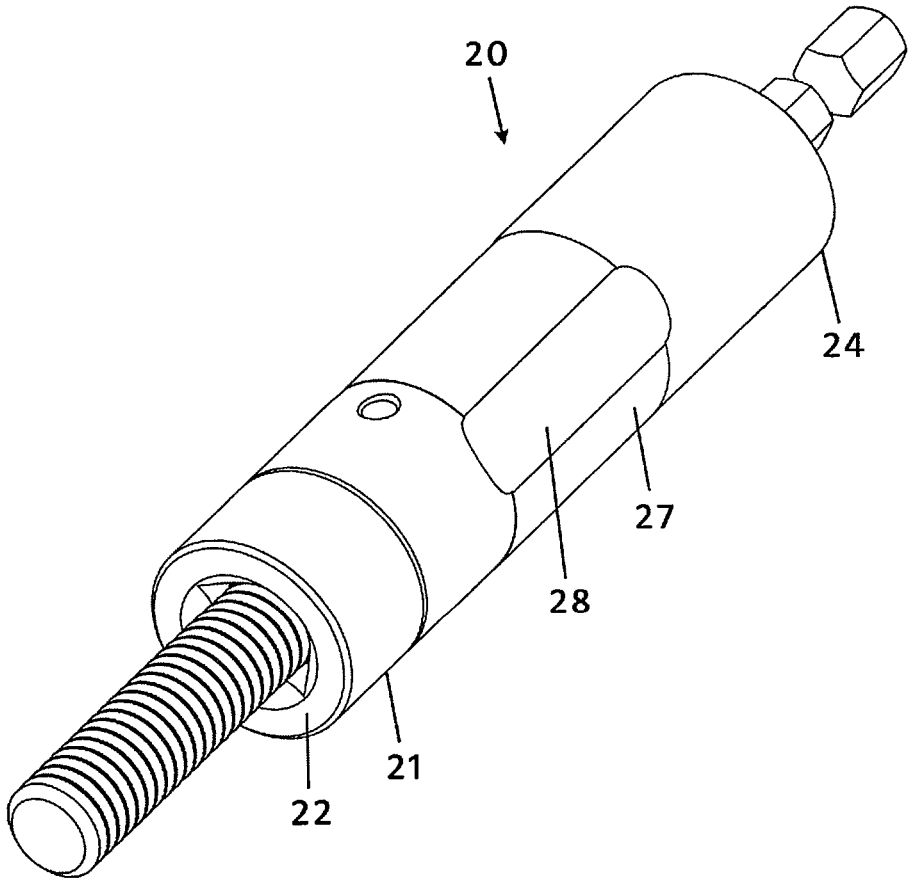
FIG. 29 is another perspective view of the socket tool as in FIG. 28, illustrated with a hex head bolt fully inserted into the second end of the socket tool and a socket adapter engaged with the first end thereof.
Figure 30:
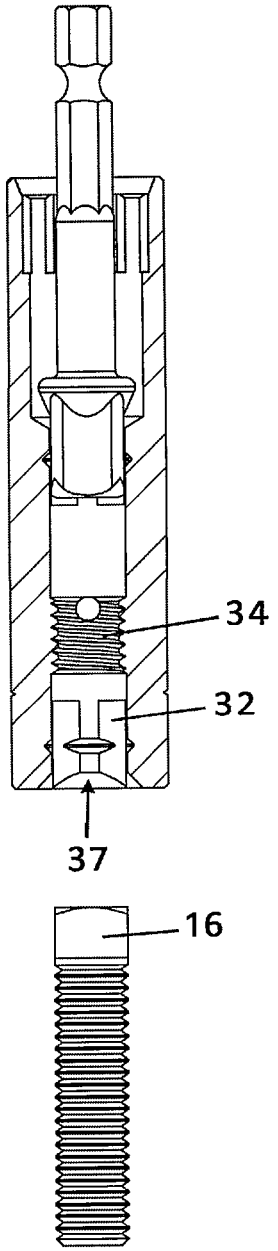
FIG. 30 is a sectional view as in FIG. 5B, illustrated in use with a hex head bolt not yet inserted into the second end.
Figure 31:
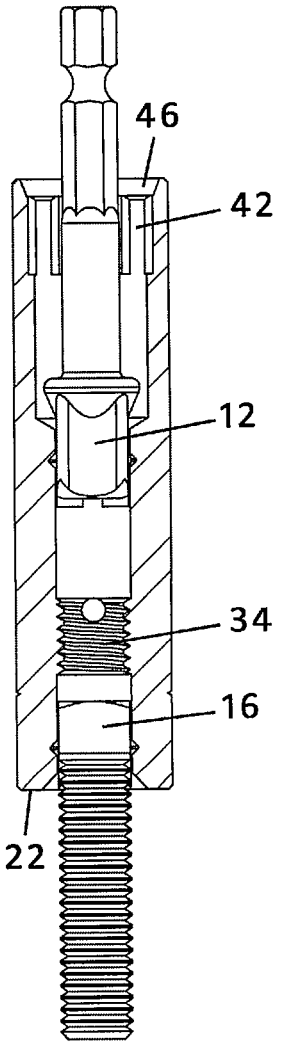
FIG. 31 is a sectional view as in FIG. 30, illustrated with the hex head bolt fully inserted into the second end.
Figure 32:
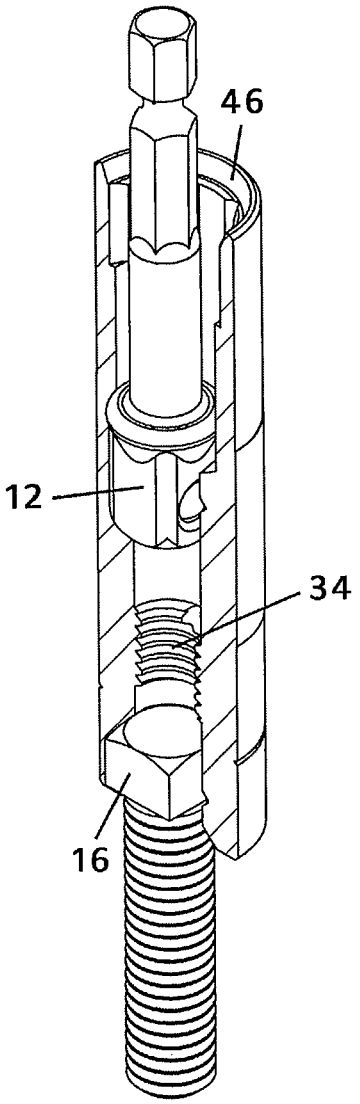
FIG. 32 is a fragmentary perspective view of the socket tool as in FIG. 31.
Figure 33:
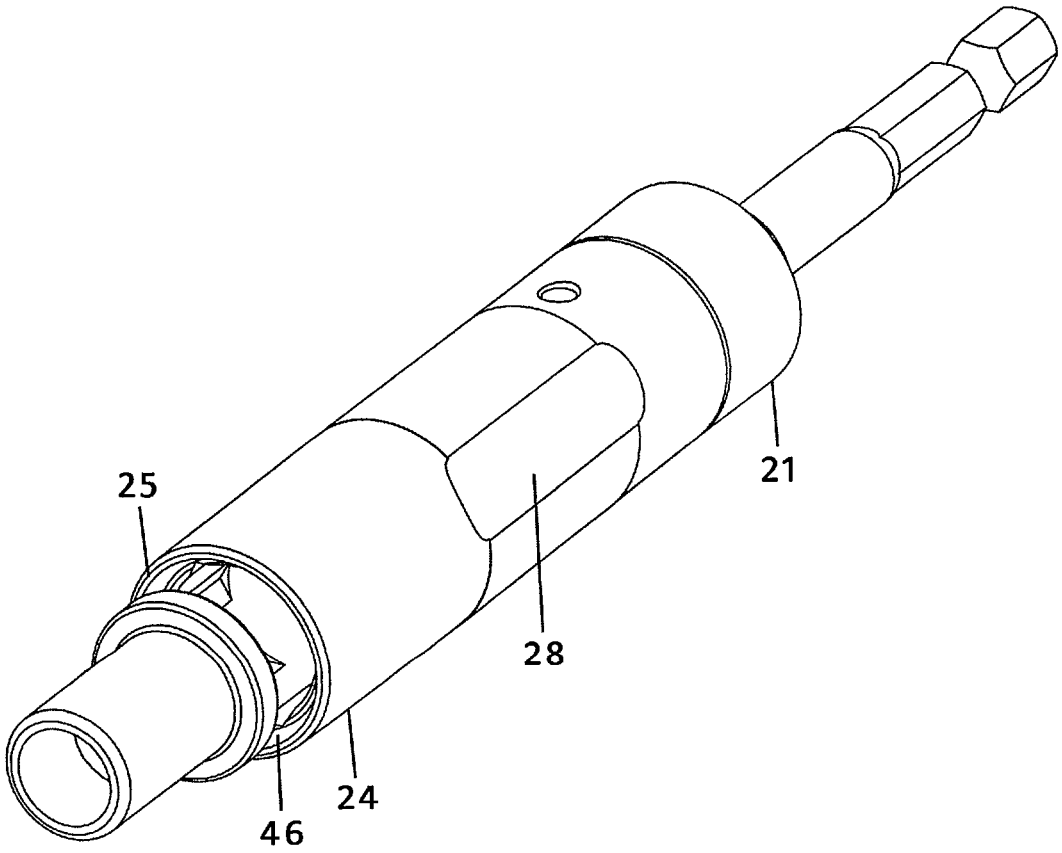
FIG. 33 is a perspective view of the socket tool as in FIG. 2, illustrated in use with another fitting not yet inserted into the second end of the socket tool and a socket adapter proximate the first end thereof.
Figure 34:
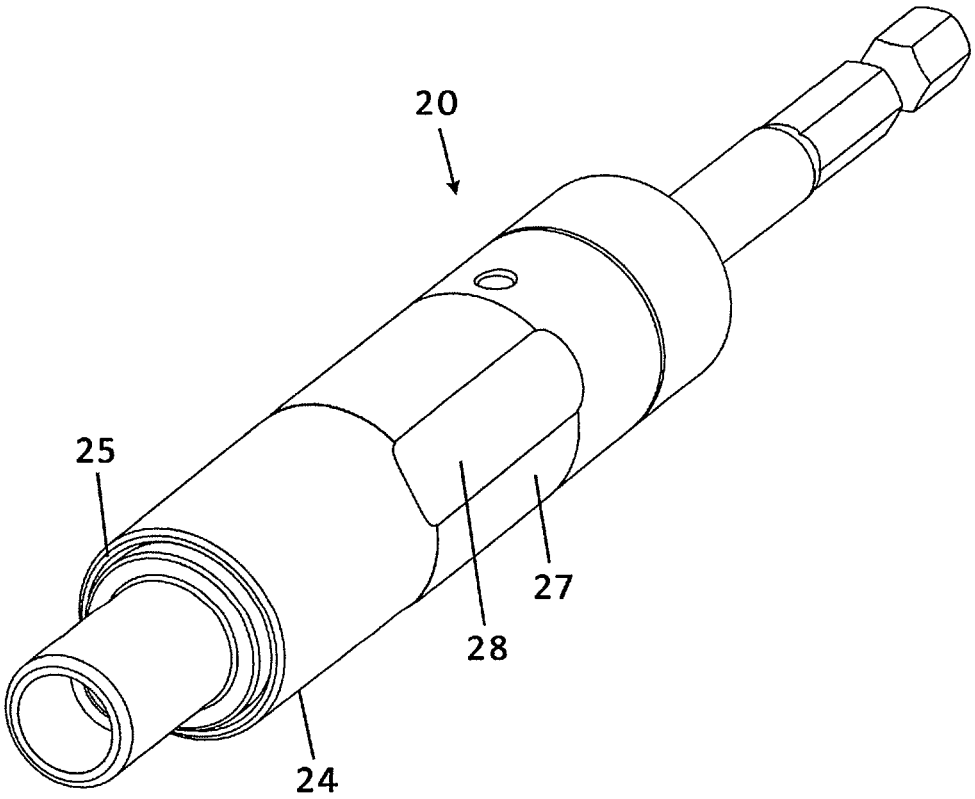
FIG. 34 is another perspective view of the socket tool as in FIG. 33, illustrated with the another fitting fully inserted into the second end of the socket tool and a socket adapter engaged with the first end thereof.
Figure 35:
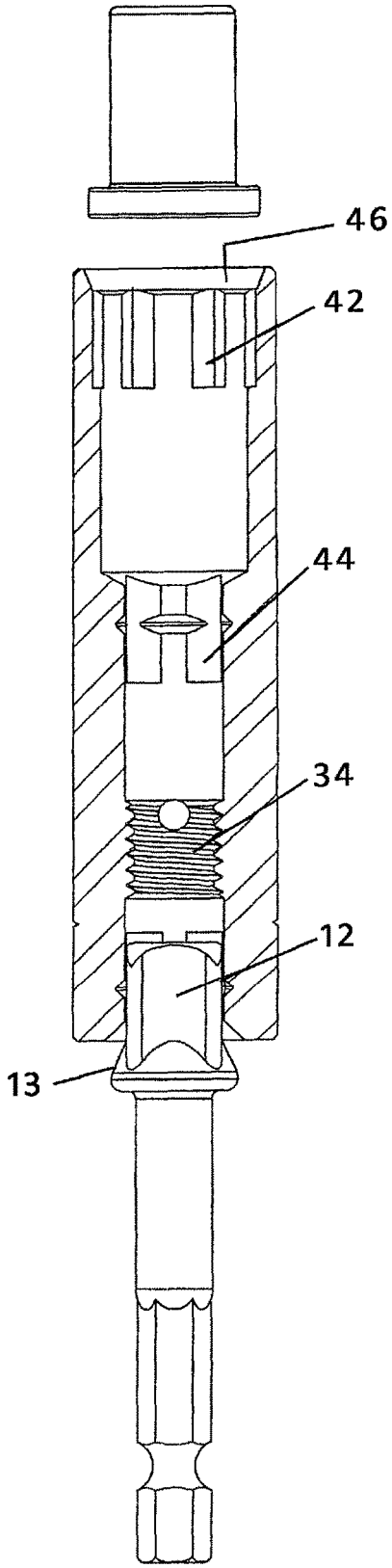
FIG. 35 is a sectional view as in FIG. 5B, illustrated in use with the another fitting not yet inserted into the second end.
Figure 36:
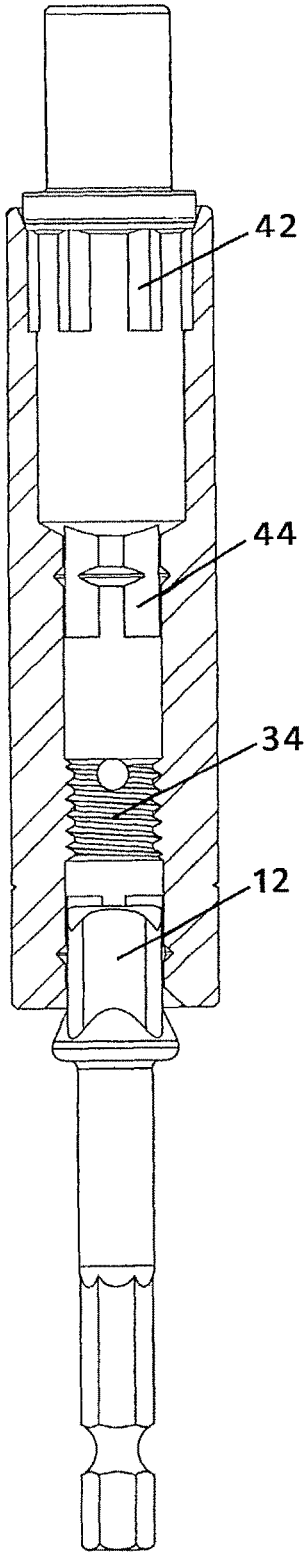
FIG. 36 is a sectional view as in FIG. 35, illustrated with the another fitting fully inserted into the second end.
Figure 37:
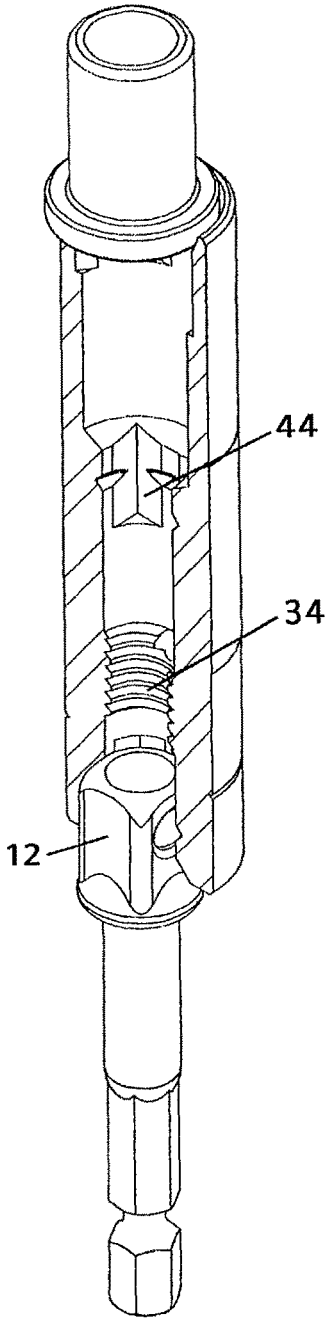
FIG. 37 is a fragmentary perspective view of the socket tool as in FIG. 36.

The first connective portion 30 associated with the first end 21 of the tool body 20 includes three segments, each segment having a different, but related, configuration capable of receiving a specifically complementary type of connective assembly while not blocking or interrupting use of any other segment. More particularly, the first connective portion 30 includes a first segment 32 proximate the first edge 22 of the first end 21 having four walls 33 spaced apart from one another so as to form an interior space. Preferably, the first segment 32 of the first connective portion 30 is displaced slightly from the first edge 22, i.e. is offset slightly toward the interior area of the tool body 20. The interior space has a square shaped configuration suitable to receive a square connective assembly, such as a socket adapter 12 (FIGS. 8 and 9). In a specific embodiment, the interior space may be sized to receive a ⅜" socket adapter.

In a related aspect, the first connective portion 30 associated with the first end 21 may include a third segment 37 immediately adjacent the first edge 22 and, thus, may be seen as being sandwiched between the first edge 22 and the first segment 32. The third segment 37 of the first connective portion 30 includes four spaced apart surfaces 38 in communication with the first edge 22, each surface being a recess into the interior surface of the tool body 20 immediately adjacent the first end 21. Each surface of the four surfaces of the third segment 37 of the first connective portion 30 has a dimension capable of receiving respective end flanges 13 of a socket adapter 12 so as to provide a stop for insertion thereof (FIGS. 9 an 10).

In another related aspect, the first connective portion 30 associated with the first end 21 may include a second segment 34 having a tubular member that has a threaded surface. The tubular member of the second segment 34 of the first connective portion 30 defines an interior space that is dimensioned and operable to receive a complementary connective assembly. Specifically, the tubular member is configured to receive a threaded rod 35 (FIGS. 25 to 27)—a reverse action of a drill or impact wrench allowing the threaded rod 35 to be installed into a work piece. Further, the second segment 34 of the first connective portion 30 may include a through-rod 36 having a linear configuration and extending between opposed points of the interior surface of the threaded surface. It will be understood and appreciated that the through-rod 36 may act as a stop against over-insertion of the threaded rod 35.

Now, the at least three segments of the second connective portion 40 associated with the second end 24 of the tool body 20 will be described in detail. The second connective portion 40 associated with the second end 24 includes a first segment 42 having walls arranged in a hexagonal configuration, the walls of the first segment being proximate and slightly inwardly displaced from the second edge 25 of the second end 24. The first segment 42 of the second connective portion 40 is configured and operable to grip a connective assembly having a complementary configuration, such as, for instance, the square head 16 of a bolt (FIGS. 18-22).

In a related aspect, the second connective portion 40 associated with the second end 24 may include a third segment 46 immediately adjacent the second edge 25 and, thus, may be seen as being sandwiched between the second edge 25 and the first segment 42 of the second connective portion 40. The third segment 46 of the second connective portion 40 includes a beveled surface in communication with the second edge 25, the beveled surface having a rough configuration operable to receive and grip a connective assembly having a complementary threaded configuration, such as a hanger fitting. The rough surface may be scored or machined to have a course finish that is complementary to gripping a hanger fitting. The third segment 46 of the second connective portion 40 is essentially sandwiched between the first segment 42 of the second connective portion 40 and the second edge 25 of the tool body 20.

In another related aspect, the second connective portion 40 associated with the second end 24 may include a second segment 44 interiorly or inwardly adjacent and displaced from the first segment 42 of the second connective portion 40. The second segment 44 of the second connective portion 40 may include four walls 45 that are spaced apart to form a housing configured and operable to receive a connective assembly having a square shaped configuration, such as a socket adapter and, even more specifically, to a ⅜" socket adapter.

With further reference to the tool body 20, the exterior surface of the casing may include a surface that enhances the grip of a user and, preferably, so that the tool body 20 may be gripped, guided, and utilized with a single hand of a user and so that the user can operate a battery-powered wrench or impact driver with the other hand. The grip surface may also be referred to as a grip member 27 and may be a raised, bumpy, or grooved surface and may extend over an entirety of the exterior surface or over just a portion of it. In addition, the exterior surface of the casing may define a recess 28 or similar cutout at the bottom of which a brand name, company name, logo, or other indicia may be imprinted.

Figure 3:
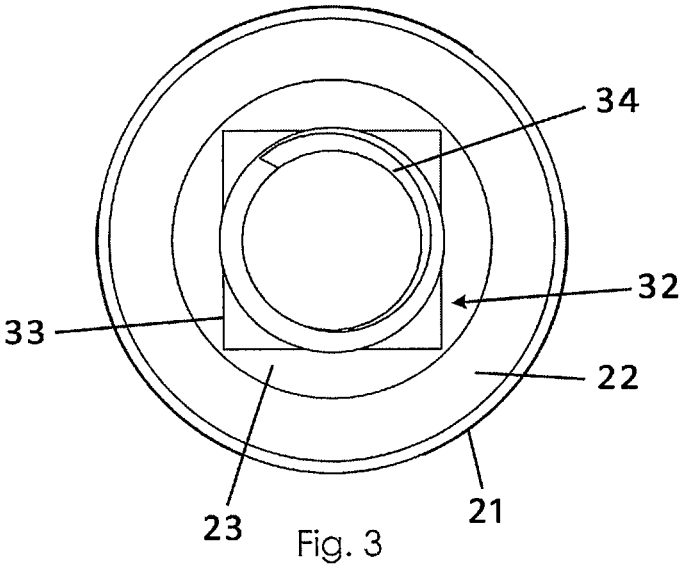
FIG. 3 is a side view of the socket tool as in FIG. 1.
Figure 4:
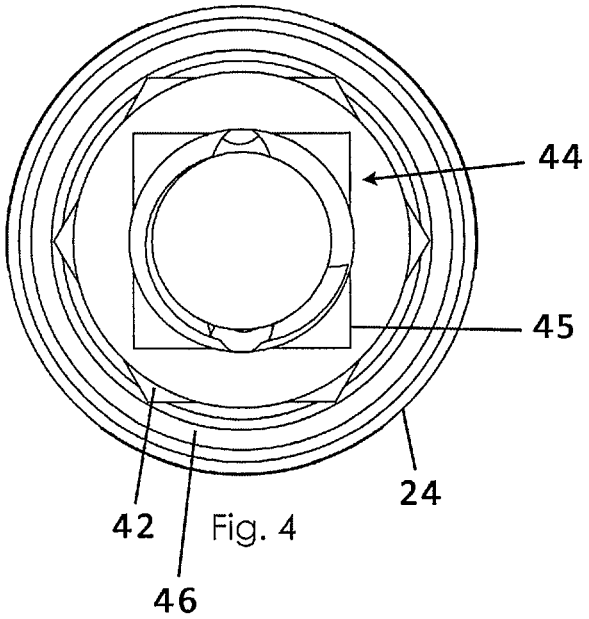
FIG. 4 is a side view of the socket tool as in FIG. 2.
Figure 5A:
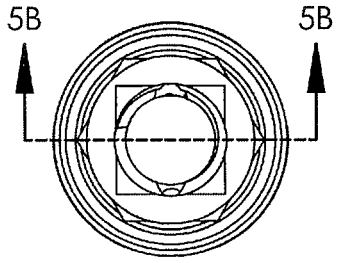
FIG. 5A is another side view of the socket tool as in FIG. 2.
Figure 5B:
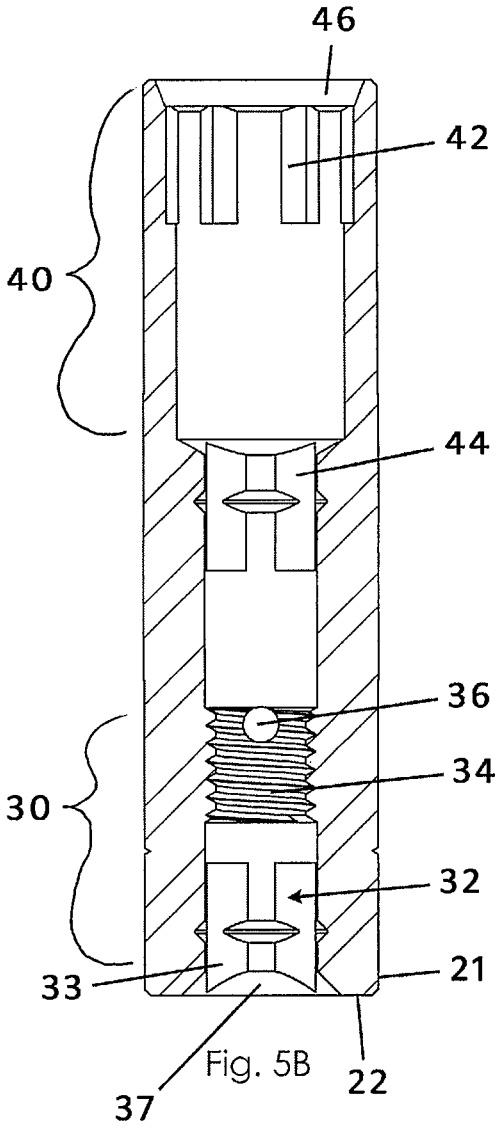
FIG. 5B is a sectional view taken along line 5B-5B of FIG. 5A.
Figure 6:
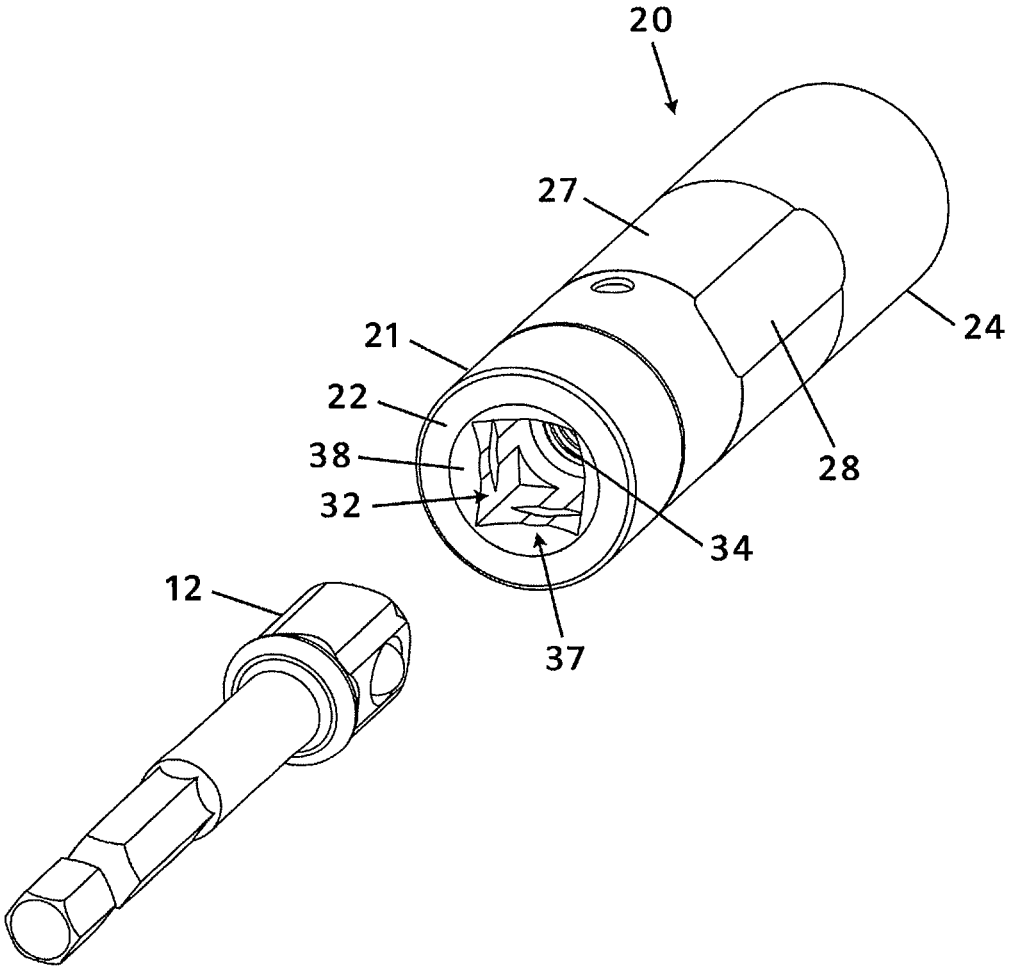
FIG. 6 is a perspective view of the socket tool as in FIG. 1, illustrated in use with a socket adapter not yet inserted.
Figure 7:
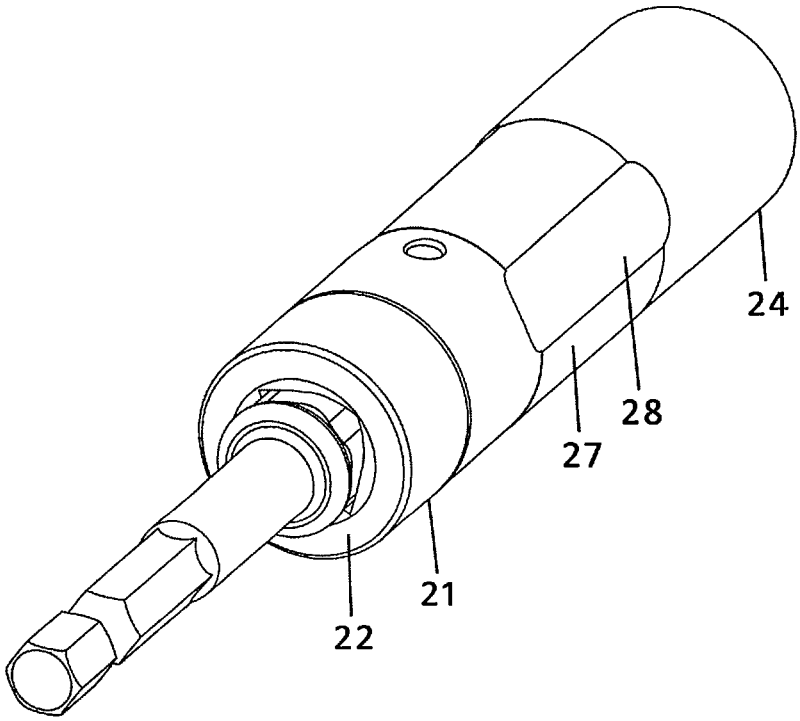
FIG. 7 is another perspective view of the socket tool as in FIG. 1, illustrated in use with a socket adapter fully inserted.

Now with reference to FIGS. 3 and 4, respective segments of respective connective portions are dimensioned so that respective connective assemblies may be received through respective insertion apertures without conflicting or colliding with other segments. More particularly and with reference to FIG. 3, recall that the first segment 32 of the first connecting portion includes four walls arranged in a square pattern operable to receive a square connective assembly such as a square shaped socket adapter or the like. The length of a side (or, stated another way, the distance or space between opposed walls, must be at least equal to or slightly larger than an inner diameter of the tubular member of the second segment 34 of the first connective portion 30 so that the threaded rod 35 is allowed and able to be received without conflict or collision into the interior space defined by the tubular member. Similarly and with reference to FIG. 4, the hexagonal shape of the first segment 42 of the second connective portion 40 defines an opening and diameter that is greater than a length of opposed walls that comprise the second segment 44 of the second connective portion 40, respectively. In other words, the diameter of first segment 42 of the second connective portion 40 must be large enough to enable a socket head or the like to enter through the second insertion aperture 26 and engage the second segment 44 of the second connective portion 40 without conflict or collision.

In use, the multi-functional socket tool 10 may be used with a battery powered socket wrench to receive a plurality of types of fasteners and to receive a socket tool for operation either forward or in reverse. In some cases, a fastener (often referred to above generically as a respective connective assembly) may be secured in a respective segment adjacent one end of the tool body 20 while the end of a battery-powered socket tool may be inserted and secured in the opposed end of the tool body 20 such that operation of the socket tool causes the fastener to be installed or uninstalled. As can be imagined or surmised, the tool body 20 is ever present and may used, quickly flipped around, used again with the socket wrench, and so on until a complex job with multiple different types of fasteners, nuts, bolts, hangers, rods, and the like have been installed as described above.

It is understood that while certain forms of this invention have been illustrated and described, it is not limited thereto except insofar as such limitations are included in the following claims and allowable functional equivalents thereof.

The invention claimed is:

1. A multi-functional socket tool for receiving a plurality of connective assemblies, comprising:

a tool body having a cylindrical configuration defining a hollow interior area and including a first end opposite a second end, said first end having a first connective portion and said second end having a second connective portion;

wherein said first end has a first edge defining a first insertion aperture giving access to said interior area and operable to receive the connective assemblies;

wherein said second end has a second edge defining a second insertion aperture giving access to said interior area to receive the connective assemblies;

wherein said first connective portion includes a first segment proximate said first end having four walls defining a square-shaped open space operable to receive a connective assembly having a square configuration;

wherein said first connective portion includes a second segment displaced interiorly from said first segment, said second segment of said first connective portion having a tubular member and a threaded surface operable to receive a threaded connective assembly;

wherein said second connective portion includes a first segment proximate said second end and having a hexagonal configuration operable to receive a connective assembly having a hexagonal configuration;

wherein said second connective portion includes a second segment interiorly displaced from said first segment of said second connective portion and having four walls that define a housing operable to receive a connective assembly having a square shaped configuration.

2. The multi-functional socket tool as in claim 1, wherein:

said first connective portion includes a third segment sandwiched between said first segment of said first connective portion and said first insertion aperture, said third segment of said first connective portion including four spaced apart surfaces in communication with said first edge, respectively;

said second connective portion includes a third segment sandwiched between said first segment of said second connective portion and said second insertion aperture, said third segment of said second connective portion including a beveled surface in communication with said second edge, respectively, said third segment of said second connective portion being operable to hold a connective assembly in the form of a hanger fitting.

3. The multi-functional socket tool as in claim 2, wherein said beveled surface of said third segment of said second connective portion has a roughened surface.

4. The multi-functional socket tool as in claim 1, wherein said second segment of said first connective portion includes a through-rod extending between opposed points of an interior surface of said threaded surface and operable as a stop.

5. The multi-functional socket tool as in claim 1, wherein said first segment of said first connective portion is interiorly displaced from said first end and configured to receive a socket adapter inserted through said first insertion aperture.

6. The multi-functional socket tool as in claim 1, wherein said first segment of said second connective portion is interiorly displaced from said second end and configured to receive a hex head nut inserted through said second insertion aperture.

7. The multi-functional socket tool as in claim 1, wherein said tool body includes an exterior surface and a grip member on a portion of said exterior surface.

8. The multi-functional socket tool as in claim 7, wherein said exterior surface of said tool body defines a recessed area operable to display indicia.

9. The multi-functional socket tool as in claim 1 wherein a length of a respective wall of said first segment of said first connective portion is equal to or larger than an inner diameter of said tubular member of said first connective portion.

10. The multi-functional socket tool as in claim 1, wherein said hexagonal configuration of said first segment of said second connective portion defines a diameter that is greater than a length of a respective wall of said four walls of said second segment of said second connective portion, respectively, so that a socket adapter is selectively received into said housing defined by said second segment of said second connector portion.

11. A multi-functional socket tool for receiving a plurality of connective assemblies, comprising:

a tool body having a cylindrical configuration defining a hollow interior area and including a first end opposite a second end, said first end having a first connective portion and said second end having a second connective portion;

wherein said first end has a first edge defining a first insertion aperture giving access to said interior area and operable to receive the connective assemblies;

wherein said first connective portion includes:

a first segment proximate said first end having four walls defining a square-shaped open space operable to receive a connective assembly having a square configuration;

a second segment displaced interiorly from said first segment, said second segment having a tubular member and a threaded surface operable to receive a threaded connective assembly;

wherein said second segment of said first connective portion includes a through-rod extending between opposed points of an interior surface of said threaded surface and operable as a stop.

12. The multi-functional socket tool as in claim 11, wherein:

said second end has a second edge defining a second insertion aperture giving access to said interior area to receive the connective assemblies;

said second connective portion includes a first segment proximate said second end and having a hexagonal configuration operable to receive a connective assembly having a hexagonal configuration.

13. The multi-functional socket tool as in claim 12, wherein said second connective portion includes a second segment interiorly displaced from said first segment of said second connective portion and having four walls that define a housing operable to receive a connective assembly having a square shaped configuration.

14. The multi-functional socket tool as in claim 13, wherein said housing defines an interior space operable to receive a socket adapter.

15. The multi-functional socket tool as in claim 14, wherein:

said first connective portion includes a third segment sandwiched between said first segment of said first connective portion and said first insertion aperture, said third segment of said first connective portion including four spaced apart surfaces in communication with said first edge, respectively;

said second connective portion includes a third segment sandwiched between said first segment of said second connective portion and said second insertion aperture, said third segment of said second connective portion including a beveled surface in communication with said second edge, respectively, said third segment of said second connective portion being operable to hold a connective assembly in the form of a hanger fitting.

16. The multi-functional socket tool as in claim 15, wherein said beveled surface of said third segment of said second connective portion has a course surface.

17. The multi-functional socket tool as in claim 12, wherein said first segment of said second connective portion is interiorly displaced from said second end and configured to receive a ⅜" hex head nut inserted through said second insertion aperture.

18. The multi-functional socket tool as in claim 11, wherein said first segment of said first connective portion is interiorly displaced from said first end and configured to receive a ⅜" socket adapter inserted through said first insertion aperture.

19. The multi-functional socket tool as in claim 11, wherein said exterior surface of said tool body defines a recessed area operable to display indicia.

* * * * *